United States Patent [19]

Okazaki

[11] Patent Number: 4,607,723

[45] Date of Patent: Aug. 26, 1986

[54] EXHAUST SYSTEM FOR OUTBOARD MOTORS

[75] Inventor: Masaki Okazaki, Shizuoka, Japan

[73] Assignee: Sanshin Kogyo Kabushiki Kaisha, Japan

[21] Appl. No.: 655,934

[22] Filed: Sep. 28, 1984

[30] Foreign Application Priority Data

Sep. 29, 1983 [JP] Japan ..... 58-179295

[51] Int. Cl.[4] ..... F01N 1/08

[52] U.S. Cl. ..... 181/272; 181/235; 181/239; 181/273; 181/276; 440/89; 60/312

[58] Field of Search ..... 181/204, 235, 212, 229, 181/233, 240, 269, 272, 239, 273, 276; 440/89; 60/312

[56] References Cited

U.S. PATENT DOCUMENTS 3,045,423 7/1962 Hulsebus ..... 181/235 X 3,967,446 7/1976 Harralson et al. ..... 60/312

4,421,490 12/1983 Nakahama ..... 440/89

FOREIGN PATENT DOCUMENTS 0080994 5/1982 Japan ..... 440/89

*Primary Examiner*—Benjamin R. Fuller

*Attorney, Agent, or Firm*—Ernest A. Beutler

[57] ABSTRACT

Two embodiments of outboard motors incorporating improved silencing systems for the exhaust gases of the powering engine. In each embodiment, a Helmholtz resonator is provided by a resonance chamber formed at least in part by a spacer plate that is interposed between the power head and drive shaft housing of the engine and which communicates with an expansion chamber of the engine through a tuning neck. In each embodiment, the effective volume of the resonance chamber of the Helmholtz resonator is varied in response to engine speed by delivering coolant to it from the engine cooling jacket and discharging the coolant at a restricted rate.

20 Claims, 5 Drawing Figures

EXHAUST SYSTEM FOR OUTBOARD MOTORS

BACKGROUND OF THE INVENTION

This invention relates to an exhaust system for outboard motors and more particularly to an improved and compact silencing system for such motors.

As is well known, an outboard motor includes a silencing system for silencing the exhaust gases from its engine before they are discharged to the atmosphere. Because of the compact nature of an outboard motor, it is difficult to provide an effective silencing system that will silence all frequency ranges throughout the running of the engine. Normally, it is the practice to employ an expansion chamber that is formed within the drive shaft housing for performing a large portion of the silencing. It is also common practice to discharge the exhaust gases from this expansion chamber through an underwater discharge. In this way, the body of water in which the motor is operating serves to provide a portion of the silencing. However, the underwater discharge offers too much back pressure for the exhaust gases under idling and low speed operation. Therefore, most outboard motors further employ an above the water exhaust for such low speed operation. With the above the water exhaust, the silencing effect of the water is obviously lost. It has been difficult with previously proposed exhaust systems to provide effective silencing throughout the speed range during which the exhaust gases are discharged from the above the water exhaust.

It is, therefore, a principal object of this invention to provide an improved silencing for outboard motors.

It is another object of this invention to provide a silencing system for the low speed exhaust of an outboard motor.

It is a yet further object of this invention to provide an improved, compact exhaust system for outboard motors.

As has been noted, most outboard motors operate through a wide variety of speed ranges and hence the exhaust noise occurs over a wide range of frequencies that vary as the engine speed varies. Most silencing devices, however, are effective only within certain frequency ranges. Thus, it has been the practice to provide a number of silencing devices that operate in unison so as to effectively silence a wide variety of frequencies. However, with outboard motors, the compact nature frequently does not permit the use of such a wide variety of silencing devices.

It is, therefore, a further object of this invention to provide a silencing device that is effective over a wide range of frequencies.

It is a further object of this invention to provide a silencing device for an outboard motor that is automatically operative to silence varying frequencies of the engine noise.

SUMMARY OF THE INVENTION

A first feature of this invention is adapted to be embodied in a silencing system for an outboard motor having a power head containing an internal combustion engine. A drive shaft housing depends from the power head and a lower unit is positioned beneath the drive shaft housing. In accordance with this feature of the invention, exhaust discharge means deliver exhaust gases from the power head engine into the drive shaft housing. An exhaust outlet is provided for discharging the exhaust gases to the atmosphere from the drive shaft housing. A resonance chamber is defined above the drive shaft housing and tuning tube means extend from the drive shaft housing into the resonance chamber for effecting silencing.

Another feature of the invention is also adapted to be embodied in a silencing system for an outboard motor having a power head containing an internal combustion engine, a drive shaft housing depending from the power head and a lower unit beneath the drive shaft housing. In accordance with this feature of the invention, exhaust silencing means are provided for silencing the exhaust gases delivered from the engine and before their exhaust to the atmosphere. The exhaust silencing means includes a resonance chamber and a tuning tube that extends into the resonance chamber. In accordance with this feature of the invention, means are provided for varying the volume of the resonance chamber in response to running conditions of the engine for silencing over a range of frequencies.

DETAILED DESCRIPTION OF THE PREFERRED EMBODIMENTS

Figure 1:
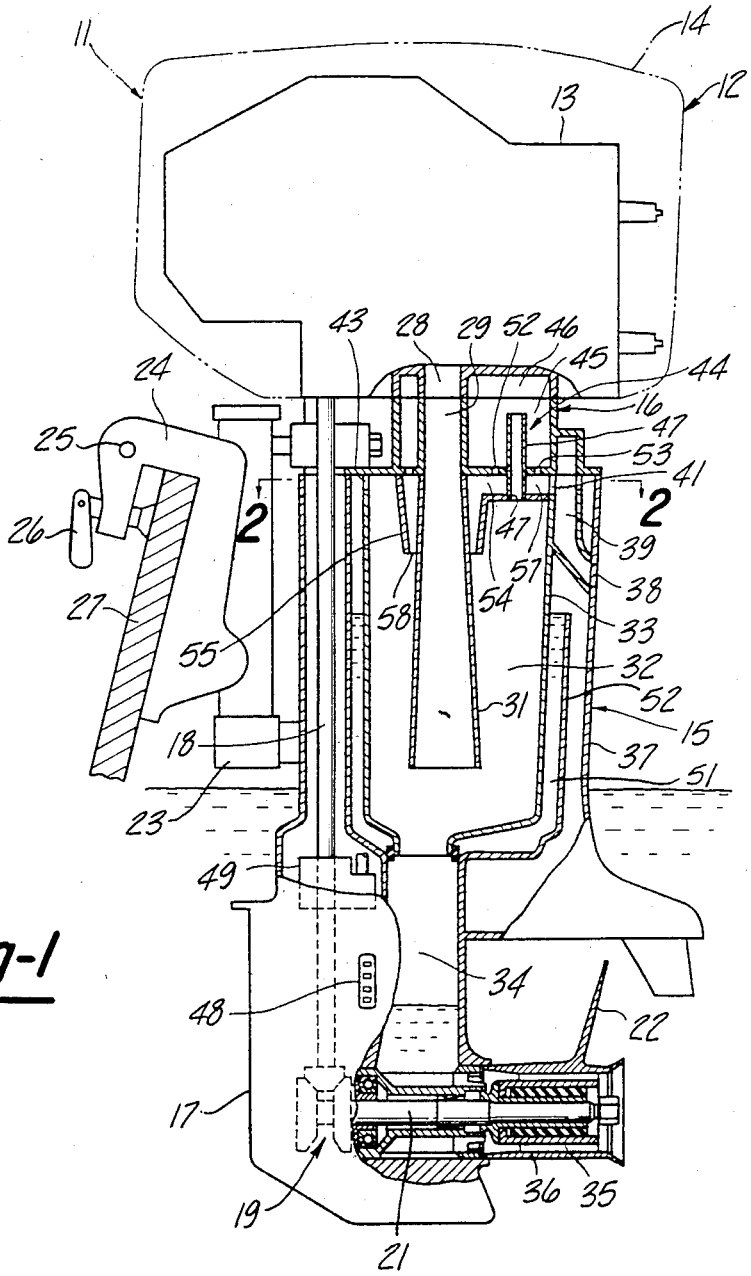
FIG. 1 is a side elevational view, with portions broken away and other portions shown in phantom, of an outboard motor constructed in accordance with a first embodiment of the invention and attached to the transom of an associated watercraft.
Figure 2:
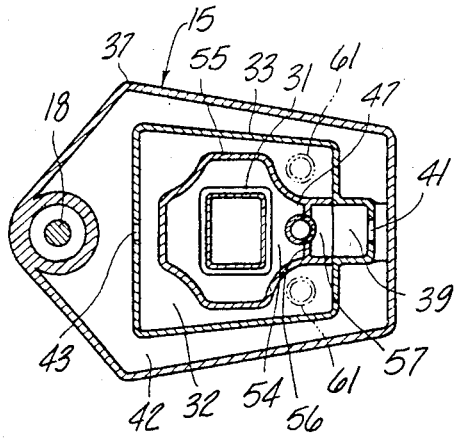
FIG. 2 is a cross-sectional view taken along the line 2—2 of FIG. 1.
Figure 3:
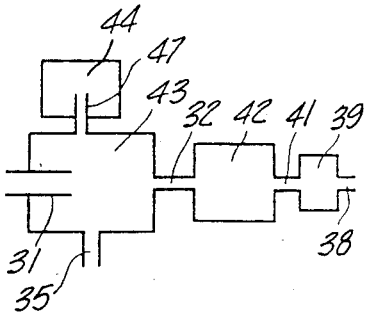
FIG. 3 is a schematic view showing the silencing system of the embodiment of FIGS. 1 and 2.

Referring first to the embodiment of FIGS. 1 through 3, an outboard motor constructed in accordance with this embodiment is identified generally by the reference numeral 11. The outboard motor 11 includes a power head, indicated generally by the reference numeral 12, and consisting of an internal combustion engine 13, which may be of any known type, and a surrounding protective cowling, which is shown in phantom and which is identified by the reference numeral 14.

A drive shaft housing, indicated generally by the reference numeral 15, depends from the power head 12 and is connected to it by means of a spacer plate, indicated generally by the reference numeral 16. Depending from the drive shaft housing 15 is a lower unit 17. A drive shaft 18 extends vertically through the drive shaft housing 15, spacer plate 16 and terminates within the lower unit 17. The drive shaft 18 is driven by the output shaft of the engine 13 in a known manner. The drive shaft 18 drives a forward, neutral, reverse transmission, indicated generally by the reference numeral 19, which is contained in the lower unit 17 and which drives a propeller shaft 21. A propeller 22 is affixed to the propeller shaft 21 in a known manner.

The drive shaft housing 15 is connected by means including a steering shaft to a swivel bracket 23 for steering movement about a generally vertically extending axis. The swivel bracket 23 is, in turn, affixed to a clamping bracket 24 by means including a pivot pin 25 for tilting movement of the motor 11 about a generally horizontally extending axis defined by the pivot pin 25. The clamping bracket 24 further includes clamping means 26 so as to attach it to a transom 27 of an associated watercraft which is shown only partially in FIG. 1.

The engine 13 is provided with an exhaust system that has an exhaust gas discharge opening 28 that opens through a lower wall of the engine 13. This exhaust gas discharge opening 28 cooperates with a mating exhaust gas opening 29 that is formed integrally with the plate 16 and which, in turn, mates with an exhaust pipe 31 that is formed in the drive shaft housing 15 and which depends into an expansion chamber 32 that is formed by a surrounding wall 33 which may be formed in a suitable manner within the drive shaft housing 15. Exhaust gases from the expansion chamber 32, where the primary silencing function is achieved, may be discharged downwardly through an exhaust gas discharge passage 34 formed in the lower unit 17 and which cooperates with a suitable underwater exhaust, such as a through the propeller exhaust consisting of axially extending passages 35 formed in a hub 36 of the propeller 22.

When the outboard motor 11 and associated watercraft are travelling at high speed, the underwater exhaust passage 35 will be disposed at a relatively shallow level and the exhaust gases will have sufficient pressure so as to permit this underwater discharge. When operating at low speeds, however, the discharge 35 will be submerged to a greater extent and there would be too much back pressure to the exhaust gases by using this opening.

For this reason, a rear wall 37 of the drive shaft housing 15 is provided with an above the water exhaust gas discharge opening 38. The opening 38 receives exhaust gases from an expansion chamber 39 that is formed in the rear portion of the drive shaft housing 15 rearwardly of the main expansion chamber wall 33 and which may be defined in part by this wall. Exhaust gases flow into the expansion chamber 39 through a restricted opening 41 in a rearwardly facing surface of the wall of the member which defines the expansion chamber 39. Exhaust gases are delivered to the restricted opening 41 from an expansion chamber 42 that is formed within the outer periphery of the drive shaft housing 15 and encircling the expansion chamber 32. Exhaust gases flow between the expansion chamber 32 and the expansion chamber 42 through a restricted opening 43 formed in a front face of the expansion chamber wall 33. Hence, the low speed exhaust gases undergo three expansions in the expansion chambers 32, 42 and 39 before they are discharged to the atmosphere through the above the water exhaust gas outlet 38.

In accordance with the invention, a further device comprising a Helmholtz resonator is incorporated for silencing the exhaust gases. The Helmholtz resonator includes a resonance chamber, indicated generally by the reference numeral 44, which is made up of a first chamber portion 45, formed by the spacer plate 16, and a second chamber portion 46, formed in the lower face of the engine casting 13. A tuning neck or tube 47 extends through an upper wall of the expansion chamber 32 and communicates with the resonance chamber 44 to provide a silencing effect. As is well known with this type of tuning device, the frequencies silenced will be determined by the volume of the expansion chamber 44 and by the diameter and length of the tuning neck 47. In accordance with a feature of the invention, the effective volume of the resonance chamber 44 varies in relation to the running speed of the engine so as to provide effective tuning over a wider range of engine speeds than would be possible with a fixed volume chamber. This is achieved by delivering coolant or water from the cooling system of the engine 13 to the resonance chamber 44 and restricting the rate of discharge of water from this chamber. As a result, as the engine runs faster and more coolant is circulated, the volume of the resonance chamber 44 will be decreased and thus increasing the frequency of sounds attenutated by it, which frequency also increases as the speed of the engine increases.

Water for cooling the engine 13 is drawn in from a water inlet opening 48 that is formed in the lower unit 17. This water is circulated by a coolant pump 49 which is positioned in the lower portion of the drive shaft housing 15 and which is driven from the drive shaft 18. The coolant is delivered to the engine 13 from the pump 49 in a suitable manner and circulates through the internal cooling jacket of the engine. A portion of the cooling water is returned to a water reservoir 51 that is formed around a lower portion of the expansion chamber 32 by the wall 33 and by an inner wall 52. This maintains a uniform head of coolant around the expansion chamber 32 so as to cool the exhaust gases and to prevent the transmission of heat from them to the other components contained within the drive shaft housing 15.

In addition, a further portion of the coolant is delivered to the resonance chamber 44 of the Helmholtz resonator through suitable water passages. This water is drained from the resonance chamber 44 at a restricted rate through a first opening 52 and a second opening 53. The opening 52 communicates with a chamber 54 that is formed around the upper end of the exhaust pipe 31 by means of a baffle plate 55. The baffle plate 55 has an integral wall 56 that may be formed in part integrally with the tuning tube 47. The drain opening 53 delivers a portion of the coolant from the expansion chamber 44 to a further water cavity 57 that is formed adjacent to and which communicates with the expansion chamber 39 so as to discharge a portion of the coolant into the exhaust gases flowing from the low speed exhaust gas discharge opening 38 so as to cool and effectively silence these exhaust gases.

Coolant from the chamber 54 is permitted to flow downwardly into contact with the exhaust pipe 31 through an annular opening 58 formed by the baffle plate 55. This water cools the exhaust pipe 31 and the exhaust gases in the expansion chamber 32 so as to further improve the silencing effect in this expansion chamber.

As has been noted, the openings 52 and 53 are sized so as to restrict the rate of water discharge from the expansion chamber 44 so that the volume of water in this chamber will increase as the speed of the engine increases. This effectively reduces the volume of the expansion chamber 44 and causes it to be effective to tune higher frequency sounds. Such sounds are generated primarily at higher engine speeds and hence the volume of the chamber 44 is in effect varied in relation to the engine speed so as to improve the silencing through a wider range of engine speeds than would be possible if a fixed volume expansion chamber were employed.

Although the tuning tube 47 is formed integrally with the wall 56 in this embodiment, the tube 47 may extend in other locations as shown by the phantom line circles 61 in FIG. 2.

In the embodiment of FIGS. 1 through 3, the Helmholtz resonator communicated with the expansion chamber 32, which expansion chamber functions to silence both high speed and low speed exhaust gases. That is, all of the exhaust gases which are discharged to the atmosphere regardless of whether from the underwater exhaust gas discharge 35 or the above water exhaust gas discharge opening 38 will have communicated with the resonance chamber 44 through the tuning tube 47.

Figure 5:
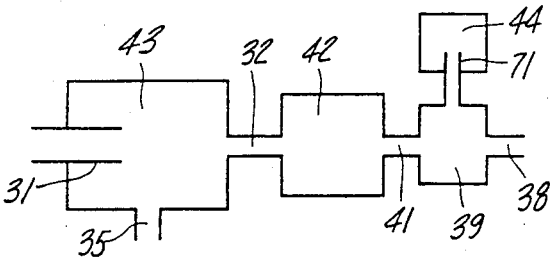
FIG. 5 is a schematic view of the silencing system of the embodiment of FIG. 4.
Figure 4:
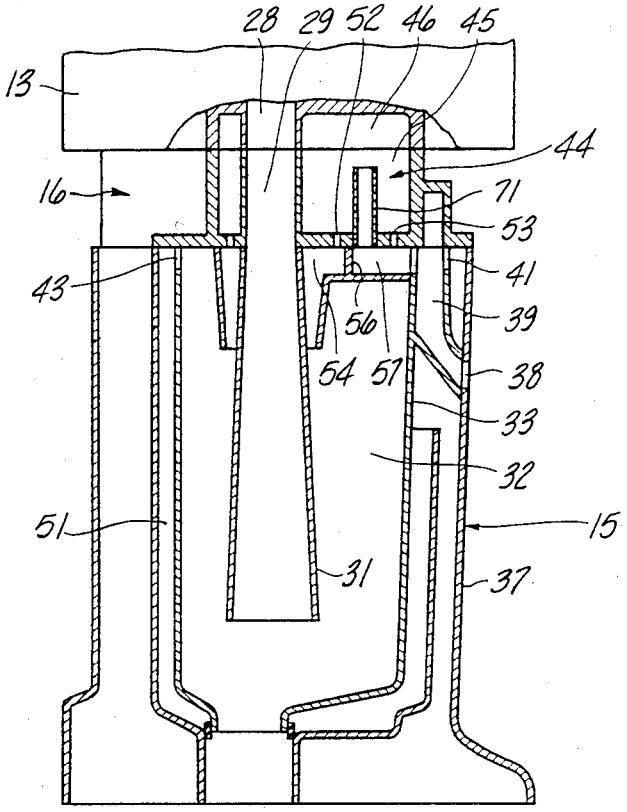
FIG. 4 is a partial cross-sectional view, in part similar to FIG. 1, and shows a further embodiment of the invention.

Another embodiment of the invention is illustrated in FIGS. 4 and 5 and in this embodiment the Helmholtz device communicates with one of the expansion chambers of the slow speed exhaust gas discharge. Since the construction of this embodiment is substantially the same as the previously described embodiment, components which are the same in construction and/or function have been identified by the same reference numerals and the description of the operation of these similar features will not be repeated.

Referring to this embodiment, the expansion chamber 31 of the slow speed exhaust, as has been noted, communicates with the chamber 57. In turn, the expansion chamber 39 communicates with the resonance chamber 44 of the Helmholtz resonator through a tube 71. Thus, as shown in the schematic of FIG. 5, the Helmholtz resonator comprised of the tube 71 and resonance chamber 44 communicates directly with the slow speed exhaust silencing expansion chamber 39 rather than with the main expansion chamber 32. As has been noted above, in other ways, this embodiment is the same as the embodiment of FIGS. 1 through 3.

It should be readily apparent from the foregoing description that two embodiments of the invention have been illustrated and described, each of which is effective to provide very efficient and compact silencing for the exhaust gases of an outboard motor. In addition, the device is operative to provide silencing over a greater range of frequencies than with previous prior art type of constructions. Although two embodiments of the invention have been illustrated and described, various other changes and modifications may be made, without departing from the spirit and scope of the invention, as defined by the appended claims.

I claim:

1. In a silencing system for an outboard motor having a power head containing an internal combustion engine, a drive shaft housing depending from said power head, and a lower unit beneath said drive shaft housing, the improvement comprising exhaust discharge means for delivering exhaust gases from said power head engine into said drive shaft housing, an exhaust outlet for discharging exhaust gases from said drive shaft housing, a resonance chamber defined above said drive shaft housing and tuning tube means extending from said drive shaft housing into said resonance chamber for silencing exhaust gases prior to their discharge to the atmosphere.

2. In a silencing system as set forth in claim 1 further including means for varying the volume of the resonance chamber in response to an engine running condition.

3. In a silencing system as set forth in claim 2 wherein the volume of the resonance chamber is decreased in response to increase in engine speeds.

4. In a silencing system as set forth in claim 3 wherein the volume of the resonance chamber is varied by delivering coolant to it from the engine cooling system and discharging coolant from the resonance chamber at a restricted rate.

5. In a silencing system as set forth in claim 1 wherein the resonance chamber is formed at least in part by a spacer plate interposed between the engine and the drive shaft housing.

6. In a silencing system as set forth in claim 5 wherein the resonance chamber is further defined by a lower face of the engine.

7. In a silencing system as set forth in claim 1 wherein there is an expansion chamber formed in the drive shaft housing and the exhaust gases are delivered to the expansion chamber directly from the power head engine.

8. In a silencing system as set forth in claim 7 wherein the exhaust gases are delivered to the expansion chamber through an exhaust pipe.

9. In a silencing system as set forth in claim 7 wherein the exhaust outlet includes an above the water exhaust gas discharge formed in the drive shaft housing.

10. In a silencing system as set forth in claim 9 wherein the above the water exhaust gas discharge receives gases from the expansion chamber through a series of expansion chambers and the tuning tube communicates one of the expansion chambers with the resonance chamber.

11. In a silencing system as set forth in claim 10 wherein the expansion chamber communicating with the resonance chamber is other than the first mentioned expansion chamber.

12. In a silencing system as set forth in claim 11 further including means for varying the effective volume of the resonance chamber.

13. In a silencing system as set forth in claim 12 wherein the effective volume is varied by delivering coolant from the engine cooling jacket to the resonance chamber and discharging coolant from the resonance chamber at a restricted rate.

14. In a silencing system as set forth in claim 10 wherein the resonance chamber communicates with the first mentioned expansion chamber.

15. In a silencing system as set forth in claim 14 further including means for varying the effective volume of the resonance chamber.

16. In a silencing system as set forth in claim 15 wherein the effective volume is varied by delivering coolant from the engine cooling jacket to the resonance chamber and discharging coolant from the resonance chamber at a restricted rate.

17. In a silencing system as set forth in claim 16 wherein the effective volume is varied by delivering coolant from the engine cooling jacket to the resonance chamber and discharging coolant from the resonance chamber at a restricted rate.

18. In a silencing system for an outboard motor having a power head containing an internal combustion engine, a drive shaft housing depending from said power head, and a lower unit beneath said drive shaft housing, the improvement comprising exhaust discharge means for delivering exhaust gases from the power head engine to the atmosphere, means defining a resonance chamber having a volume, tuning tube means extending into the resonance chamber from the exhaust gas discharge means for communication of exhaust gases with said resonance chamber, and means for varying the volume of the resonance chamber in response to an engine running condition.

19. In a silencing system as set forth claim 18 wherein the volume of the resonance chamber is varied in response to engine speed.

20. In a silencing system as set forth claim 19 wherein the volume of the resonance chamber is decreased in response to increase in engine speeds by delivering engine coolant to aid resonance chamber and draining it at a restricted rate.

* * * * *

UNITED STATES PATENT AND TRADEMARK OFFICE

CERTIFICATE OF CORRECTION

PATENT NO. : 4,607,723

DATED : August 26, 1986

INVENTOR(S) : Masaki Okazaki

It is certified that error appears in the above-identified patent and that said Letters Patent is hereby corrected as shown below:

Column 3, line, 40, after "41" insert --formed--.

Column 4, line 10, "attenutated" should be --attenuated--.

Column 5, line 2, "communicated" should be --communicates--.

Column 6, line 60, Claim 19, after "forth" insert --in--.

Column 6, line 63, Claim 20, after "forth" insert --in--.

Column 6, line 67, Claim 20, "aid" should be --said--.

Signed and Sealed this

Sixth Day of January, 1987

*Attest:*

DONALD J. QUIGG

*Attesting Officer*

*Commissioner of Patents and Trademarks*